US012473606B2

(12) United States Patent
Kurisu et al.

(10) Patent No.: US 12,473,606 B2
(45) Date of Patent: Nov. 18, 2025

(54) HEARTH ROLL FOR CONTINUOUS ANNEALING FURNACE

(71) Applicants: NIPPON STEEL CORPORATION, Tokyo (JP); NIPPON STEEL HARDFACING CORPORATION, Tokyo (JP)

(72) Inventors: Yasushi Kurisu, Tokyo (JP); Yu Li, Tokyo (JP); Koji Yagyu, Tokyo (JP)

(73) Assignees: NIPPON STEEL CORPORATION, Tokyo (JP); NIPPON STEEL HARDFACING CORPORATION, Tokyo (JP)

( * ) Notice: Subject to any disclaimer, the term of this patent is extended or adjusted under 35 U.S.C. 154(b) by 0 days.

(21) Appl. No.: 19/192,995

(22) Filed: Apr. 29, 2025

(65) Prior Publication Data

US 2025/0257417 A1 Aug. 14, 2025

Related U.S. Application Data

(62) Division of application No. 17/773,629, filed as application No. PCT/JP2020/047905 on Dec. 22, 2020, now Pat. No. 12,312,646.

(30) Foreign Application Priority Data

Dec. 23, 2019 (JP) ..... 2019-231246

(51) Int. Cl.
*C21D 9/00* (2006.01)
*C21D 9/56* (2006.01)
(Continued)

(52) U.S. Cl.
CPC ..... *C21D 9/0012* (2013.01); *C21D 9/56* (2013.01); *C21D 9/563* (2013.01); *C23C 4/073* (2016.01); *C23C 4/11* (2016.01); *C23C 4/14* (2013.01)

(58) Field of Classification Search
CPC ..... C21D 9/0012; C21D 9/563; C23C 4/073; C23C 4/11; C23C 4/14
See application file for complete search history.

(56) References Cited

U.S. PATENT DOCUMENTS

2008/0241522 A1 10/2008 Mizuno et al.
2010/0230874 A1 9/2010 Kurisu et al.
(Continued)

FOREIGN PATENT DOCUMENTS

CN 101878316 A 11/2010
CN 101981220 A 2/2011
(Continued)

*Primary Examiner* — Christopher J. Besler
(74) *Attorney, Agent, or Firm* — Renner, Otto, Boisselle & Sklar, LLP

(57) ABSTRACT

A hearth roll for a continuous annealing furnace, the hearth roll comprising a thermal spray coating on a surface of the hearth roll, wherein the thermal spray coating comprises main components consisting of a Co-based alloy, a carbide of a transition metal, and a double oxide; and impurities, the double oxide consists of one or two types of a first double oxide consisting of Al and a rare earth element and a second double oxide consisting of a transition metal and a rare earth element, and when the main components are 100 mass %, a content of the Co-based alloy is 25 mass % or more and 50 mass % or less, a content of the carbide is 5 mass % or more and 30 mass % or less, and a content of the double oxide is 20 mass % or more and 45 mass % or less.

4 Claims, 1 Drawing Sheet

(51) Int. Cl.

| | |
|---|---|
| ***C23C 4/073*** | (2016.01) |
| ***C23C 4/11*** | (2016.01) |
| ***C23C 4/14*** | (2016.01) |

(56) References Cited

U.S. PATENT DOCUMENTS

| | | | |
|---|---|---|---|
| 2011/0104449 | A1 | 5/2011 | Shigemitsu et al. |
| 2013/0330520 | A1 | 12/2013 | Shigemitsu et al. |
| 2014/0038800 | A1 | 2/2014 | Shigemitsu et al. |
| 2016/0348971 | A1 | 12/2016 | Kurisu et al. |

FOREIGN PATENT DOCUMENTS

| | | | |
|---|---|---|---|
| JP | 5058645 | B2 | 10/2012 |
| JP | 5514104 | B2 | 6/2014 |

HEARTH ROLL FOR CONTINUOUS ANNEALING FURNACE

This application is a Divisional and claims priority of U.S. application Ser. No. 17/773,629, filed May 2, 2022, which is a national phase of International Application No. PCT/JP2020/047905, filed Dec. 22, 2020, which claims priority to Japanese Patent Application No. 2019-231246, filed Dec. 23, 2019, each of which is hereby incorporated herein by reference in its entirety.

TECHNICAL FIELD

The present application relates to a hearth roll for a continuous annealing furnace used in a heat treatment furnace.

BACKGROUND ART

In a manufacturing facility for metal plate materials, particularly in an iron manufacturing process line, when a conveying roll is rotated at high speed to thread a steel plate, phenomena occur such as slipping and meandering of the steel plate, and attachment and buildup of dirt to and on a surface of the conveying roll.

In particular, in a hearth roll in a continuous annealing furnace that conveys a steel plate in a high temperature state, buildup is likely to occur on a surface of the hearth roll. Buildup is a phenomenon in which iron, manganese oxide, or the like present on a surface of the steel plate is attached to and accumulated on the surface of the hearth roll. Since not only does buildup transfer, to the surface of the steel plate, the shape of deposit derived from the buildup, degrading the quality of the surface and thus the quality of the steel plate, but also leads to the need for effort to remove foreign matter attached to the surface of the hearth roll during periodic repairs, the buildup is one of the causes of reduced productivity.

To prevent this, it is expected to be effective to suppress reaction between iron, manganese oxide, or the like, which corresponds to a buildup source, and the surface of the hearth roll, or to facilitate removal of reaction products.

Patent Literature 1 discloses thermal spray powder for a thermal spray coating provided on the surface of the hearth roll, the thermal spray powder containing 30 to 50 mass % chromium carbide, a remaining portion of the thermal spray powder consisting of an alloy including at least one type of cobalt and nickel, chromium, aluminum, and yttrium, the thermal spray powder having an average particle size of 20 to 60 μm. Additionally, Patent Literature 1 discloses that a larger content of chromium carbide indicates higher buildup resistance of a thermal spray coating obtained from the thermal spray powder.

Patent Literature 2 discloses a thermal spray material thermally sprayed on a surface of the hearth roll, consisting of heat resistant metal consisting of MAI (M consists of two or more types of transition metals except a group 3A in a periodic table and Ag, Cu, and Mn) or MAI (RE) (M consists of two or more types of transition metals except the group 3A in the periodic table and Ag, Cu, and Mn, and (RE) consists of one type of rare earth element), and a double oxide consisting of one type or two or more types of rare earth elements (Sc, Y, lantern, and lanthanoid) and transition metals except the group 3A in the periodic table, and Zr, Hf, and Fe), wherein the condition $0.3 \leq (A/B) \leq 4.0$ is satisfied where the content of Al is A (mol) and the content of rare earth elements (Sc, Y, lantern, and lanthanoid) is B (mol).

CITATION LIST

Patent Literature

Patent Literature 1: Japanese Patent No. 5058645
Patent Literature 2: Japanese Patent No. 5514104

SUMMARY OF INVENTION

Technical Problem

However, as described in Patent Literature 1, an increase in the content of chromium carbide causes thermal shock resistance and crack resistance of the thermal spray coating to be degraded. Additionally, aluminum included in the thermal spray powder becomes $Al_2O_3$ during thermal spraying, and the $Al_2O_3$ reacts with MnO included in the steel plate to generate a MnAl double oxide corresponding to a starting point for buildup. In other words, a method described in Patent Literature 1 can suppress Fe-based buildup but fails to sufficiently suppress Mn-based buildup. Patent Literature 2 describes a technology taking Mn-derived buildup into consideration and has less effect on Fe-derived buildup.

Thus, an object of the present application is to improve Fe and Mn buildup resistance, thermal shock resistance, and crack resistance of a thermal spray coating while reducing the content of carbide.

Solution to Problem

To achieve the object, the present application provides a hearth roll for a continuous annealing furnace, (1) the hearth roll including a thermal spray coating on a surface of the hearth roll, wherein the thermal spray coating includes main components consisting of a Co-based alloy, a carbide of a transition metal, and a double oxide, and impurities, the double oxide consists of one or two types of a first double oxide consisting of Al and a rare earth element and a second double oxide consisting of a transition metal and a rare earth element, and when the main components are 100 mass %, a content of the Co-based alloy is 25 mass % or more and 50 mass % or less, a content of the carbide is 5 mass % or more and 30 mass % or less, and a content of the double oxide is 20 mass % or more and 45 mass % or less.

(2) The hearth roll for the continuous annealing furnace according to (1) described above, wherein the double oxide includes one type consisting of the first double oxide, $2/3 \leq (A/B) \leq 4$ is satisfied, where A and B respectively denote a molar quantity of transition metals and a molar quantity of carbon in the carbide, and $1 \leq (C/D) \leq 4$ is satisfied, where C denotes a total molar quantity of Al and the transition metals not constituting the carbide in the main components, and D denotes a molar quantity of the rare earth element included in the main components.

(3) The hearth roll for the continuous annealing furnace according to (1) described above, wherein the double oxide includes one type consisting of the second double oxide, $2/3 \leq (A/B) \leq 4$ is satisfied, where A and B respectively denote a molar quantity of transition metals and a molar quantity of carbon in the carbide, and $1 \leq (C/D) \leq 4$ is satisfied, where C denotes a molar quantity of the transition metals not constituting the carbide in the main components, and D denotes a molar quantity of the rare earth element included in the main components.

(4) The hearth roll for the continuous annealing furnace according to (1) described above, wherein the double oxide includes two types consisting of the first double oxide and the second double oxide, $2/3 \leq (A/B) \leq 4$ is satisfied, where A and B respectively denote a molar quantity of transition metals and a molar quantity of carbon in the carbide, and $1 \leq (C/D) \leq 4$ is satisfied, where C denotes a total molar quantity of Al and the transition metals not constituting the carbide in the main components, and D denotes a molar quantity of the rare earth element included in the main components.

(5) The hearth roll for the continuous annealing furnace according to any one of (1) to (4) described above, wherein the Co-based alloy is any one type of a CoCrAlY-based heat resistant alloy, a CoNiCrAlY-based heat resistant alloy, and a CoCrMoNi-based heat resistant alloy.

(6) The hearth roll for the continuous annealing furnace according to any one of (1) to (5) described above, wherein the carbide is any one type of a chromium carbide and a molybdenum carbide.

(7) The hearth roll for the continuous annealing furnace according to any one of (1), (2), and (4) described above, wherein the first double oxide is any one type of $LaAlO_3$, $NdAlO_3$, $YAlO_3$, and $Y_3Al_5O_{12}$.

(8) The hearth roll for the continuous annealing furnace according to any one of (1), (3), and (4) described above, wherein the second double oxide is any one type of $LaCrO_3$, $NdCrO_3$, and $YCrO_3$.

Advantageous Effect of Invention

According to the present embodiments, Fe and Mn buildup resistance, thermal shock resistance, and crack resistance of a thermal spray coating can be improved, with the content of carbide reduced.

DESCRIPTION OF EMBODIMENTS

Figure 1:
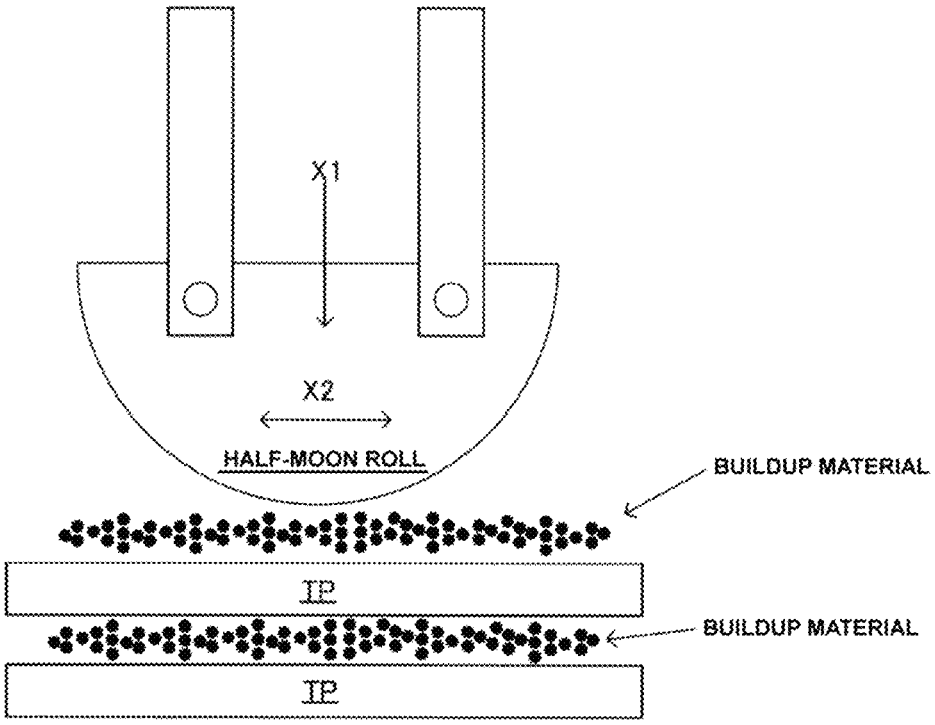
FIG. 1 is a schematic diagram of a testing apparatus used for a buildup test.

The inventors of the present application prototyped various thermal spray coatings and examined the prototyped thermal spray coatings for the status of buildup, thermal shock resistance, and crack resistance. As a result, the inventors found a hearth roll for a continuous annealing furnace, the hearth roll including, on a roll surface, a thermal spray coating including, as main components, a Co-based alloy, a carbide, and a double oxide (hereinafter sometimes simply referred to as the "main component"), the thermal spray coating being excellent in buildup suppression, thermal shock resistance, and crack resistance.

First Embodiment

The thermal spray coating according to the present embodiment is formed on the roll surface of the hearth roll for the continuous annealing furnace. The thermal spray coating includes main components and impurities. The main components consist of a Co-based alloy, a carbide of a transition metal (hereinafter sometimes simply referred to as the "carbide"), and a double oxide consisting of Al and a rare earth element (hereinafter sometimes simply referred to as the "double oxide").

(Co-Based Alloy)

The Co-based alloy is preferably a Tribaloy (registered trademark)-based heat resistant alloy, a Stellite (registered trademark)-based heat-resistant alloy, more preferably a CoCrAlY-based heat-resistant alloy, a CoNiCrAlY-based heat-resistant alloy, a CoCrMoNi-based heat-resistant alloy, or a CoCrAl-based heat-resistant alloy.

When the main components are 100 mass %, the content of Co-based alloy has a lower limit value of 25 mass % and preferably 32 mass %. The content of Co-based alloy has an upper limit value of 50 mass % and preferably 40 mass %.

When the content of Co-based alloy is less than 25 mass %, a thermal spray material includes only a small amount of binder metal, and thus the thermal spray coating is likely to be cracked, reducing thermal shock resistance and crack resistance. When the content of Co-based alloy is more than 50 mass %, the rate of Co is excessively high with respect to the carbide and the double oxide, reducing the hardness and wear resistance of the thermal spray coating. Additionally, Fe and Mn buildup resistance may be reduced.

(Carbide of Transition Metal)

The carbide is required to satisfy buildup resistance (particularly buildup resistance for an Fe-based substance). When the main components are 100 mass %, the content of carbide has a lower limit value of 5 mass % and preferably 15 mass %. The content of carbide has an upper limit value of 30 mass % and preferably 28 mass %. When the content of carbide is less than 5 mass %, the buildup resistance is significantly reduced. When the content of carbide is more than 30 mass %, the thermal shock resistance and the crack resistance are significantly reduced.

The transition metal used for the carbide is preferably Mo, Ta, or Zr, and more preferably Cr. In other words, the carbide is preferably $MO_2C$, MoC, TaC, or ZrC and more preferably $Cr_3C_2$, $Cr_7C_3$, or $Cr_{23}C_6$. The carbide is less likely to be oxidized even in a high temperature environment such as in an annealing furnace and is also less likely to react with an Fe oxide and an Mn oxide, thus allowing possible buildup to be effectively prevented.

(Double Oxide Consisting of Al and Rare Earth Element)

The double oxide is required to satisfy the buildup resistance (particularly the buildup resistance for an Mn-based substance). When the main components are 100 mass %, the content of double oxide has a lower limit value of 20 mass % and preferably 25 mass %. The content of double oxide has an upper limit value of 45 mass % and preferably 40 mass %. When the content of double oxide is less than 20 mass %, the buildup resistance is significantly reduced. When the content of double oxide is more than 45 mass %, the thermal shock resistance and the crack resistance are significantly reduced.

The rare earth element used for the double oxide is preferably La or Nd, and more preferably Y. In other words, the double oxide is preferably $LaAlO_3$ or $NdAlO_3$ and more preferably $YAlO_3$ or $Y_3Al_5O_{12}$. Y requires a relatively low cost, and can be most suitably used as a rare earth element.

(Impurities)

The impurities may be included unless the impurities inhibit the effects of the present embodiment. The impurities may be, for example, Fe, Ni, Ti, Nd, N, O, Si, Mg, Na, or C. In possible cases, the impurities may flow in as contaminants from a mixing vessel during a manufacturing process for a thermal spray coating, C from kerosene may flow in during high-velocity gas spraying, the impurities flow in due to decarburization reaction caused by plasma spraying, and so on. The impurities are desirably limited to 2 mass % or less of the whole thermal spray coating.

(Optional Elements)

Additionally, as optional elements, for example, La, Nd, Ce, and Hf may be added unless the optional elements inhibit the effects of the present embodiment. The total of the optional elements is desirably limited to 5 mass % or less of the whole thermal spray coating.

When A and B respectively denote the molar quantity of transition metal and the molar quantity of carbon in the carbide, A/B is preferably 2/3 or more and 4 or less. A more preferable lower limit value of A/B is 1. A more preferable upper limit value of A/B is 3. A/B less than 2/3 leads to excessive carbon, reducing the crack resistance and thermal shock resistance of the thermal spray coating. A/B more than 4 reduces the buildup resistance in the high temperature environment because the carbide including the transition metal has low high-temperature stability.

C/D is preferably 1 or more and 4 or less when C denotes the total molar quantity of the transition metals not constituting the carbide in the main components (in other words, the transition metal included in the Co-based alloy) and Al included in the main components, and D denotes the molar quantity of the rare earth element included in the main components (the rare earth element means a rare earth element included both in the double oxide and in the Co-based alloy in a case where the Co-based alloy includes the rare earth element, and means a rare earth element included in the double oxide in a case where the Co-based alloy includes no rare earth element). A more preferable lower limit value of C/D is 1.3. A more preferable upper limit value of C/D is 3.2. C/D less than 1 leads to excessive rare earth elements, increasing costs. C/D more than 4 increases the rate of transition metal and Al with respect to the rare earth element to generate an oxide of the transition metal and Al, thus reducing the buildup resistance of the thermal spray coating.

Second Embodiment

A thermal spray coating according to the present embodiment is formed on the roll surface of the hearth roll for the continuous annealing furnace. The thermal spray coating includes main components and impurities. The main components consist of a Co-based alloy, a carbide of a transition metal (hereinafter sometimes simply referred to as the "carbide"), and a double oxide consisting of a transition metal and a rare earth element (hereinafter sometimes simply referred to as the "double oxide"). The Co-based alloy and the carbide are similar to those in the first embodiment, and thus detailed description of the Co-based alloy and the carbide is omitted.

(Double Oxide Consisting of Transition Metal and Rare Earth Element)

The double oxide is required to satisfy the buildup resistance (particularly the buildup resistance for an Mn-based substance). When the main components are 100 mass %, the content of double oxide has a lower limit value of 20 mass % and preferably 25 mass %. The content of double oxide has an upper limit value of 45 mass % and preferably 40 mass %. When the content of double oxide is less than 20 mass %, the buildup resistance is significantly reduced. When the content of double oxide is more than 45 mass %, the thermal shock resistance and the crack resistance are significantly reduced.

The rare earth element used for the double oxide is preferably La or Nd, and more preferably Y. The transition metal used for the double oxide is preferably Mo, Ta, or Zr, and more preferably Cr. In other words, the double oxide is preferably $LaCrO_3$ or $NdCrO_3$ and more preferably $YCrO_3$. Y requires a relatively low cost, and can be most suitably used as a rare earth element.

The impurities and the optional elements are similar to those in the first embodiment, and thus detailed description of the impurities and the optional elements is omitted.

The ratio between A and B when A and B denote the molar quantity of the transition metal and the molar quantity of carbon in the carbide are similar to that in the first embodiment, and thus detailed description of the ratio is omitted.

C/D is preferably 1 or more and 4 or less when C denotes the molar quantity of the transition metals not constituting the carbide in the main components, and D denotes the molar quantity of the rare earth element included in the main components. A more preferable lower limit value of C/D is 1.3. A more preferable upper limit value of C/D is 3.2. The reason for the limitation of the ratio between C and D is similar to that in the first embodiment, and thus detailed description of the reason is omitted.

Third Embodiment

A thermal spray coating according to the present embodiment is formed on the roll surface of the hearth roll for the continuous annealing furnace. The thermal spray coating includes main components and impurities. The main components consist of a Co-based alloy, a carbide of a transition metal (hereinafter sometimes simply referred to as the "carbide"), a first double oxide consisting of Al and a rare earth element (hereinafter sometimes simply referred to as the "first double oxide"), and a second double oxide consisting of a transition metal and a rare earth element (hereinafter sometimes simply referred to as the "second double oxide"). The Co-based alloy and the carbide are similar to those in the first embodiment, and thus detailed description of the Co-based alloy and the carbide is omitted. The first double oxide is similar to the double oxide in the first embodiment, and thus detailed description of the first double oxide is omitted. The second double oxide is similar to the double oxide in the first embodiment, and thus detailed description of the second double oxide is omitted.

The impurities and the optional elements are similar to those in the first embodiment, and thus detailed description of the impurities and the optional elements is omitted.

The ratio between A and B when A and B denote the molar quantity of the transition metal and the molar quantity of carbon in the carbide is similar to that in the first embodiment, and thus detailed description of the ratio is omitted.

C/D is preferably 1 or more and 4 or less when C denotes the total molar quantity of the transition metals not constituting the carbide in the main components (the transition metal included in the Co-based alloy and in the second double oxide), and Al included in the main components, and D denotes the molar quantity of the rare earth element included in the main components. A more preferable lower limit value of C/D is 1.3. A more preferable upper limit value of C/D is 3.2. The reason for the limitation of the ratio between C and D is similar to that in the first embodiment, and thus detailed description of the reason is omitted.

Now, a method for manufacturing a hearth roll for a continuous annealing furnace will be described. As material powder, mixed powder can be used that includes, as a main component, a predetermined Co-based alloy: 25 mass % or more and 50 mass % or less, a predetermined carbide: 5 mass % or more and 30 mass % or less, and a predetermined double oxide: 20 mass % or more and 45 mass % or less. Additionally, for generation of a predetermined carbide in the material powder of the composition described above, mixed powder of metal powder and carbon or mixed powder of metal powder and carbide powder can be used and the predetermined carbide can be generated by burning heat or thermal spray heat during a process of granulating and sintering the material powder.

The predetermined Co-based alloy is a Co-based alloy as described above, and may be a Tribaloy (registered trademark)-based heat resistant alloy, a Stellite (registered trademark)-based heat-resistant alloy, or the like.

The predetermined carbide is a carbide of a transition metal as described above, and Cr, Mo, Ta, Zr, or the like can be used as the transition metal.

The predetermined double oxide is a double oxide consisting of Al and a rare earth element and/or a double oxide consisting of a transition metal and a rare earth element. As described above, Y, La, Nd, or the like can be used as the rare earth element, and Cr, Mo, Ta, Zr, or the like can be used as the transition metal.

By thermally spraying the material powder described above on the surface of the hearth roll substrate, a thermal spray coating can be formed on the surface of a hearth roll substrate. As the hearth roll substrate, for example, stainless steel-based heat resistant cast steel can be used. As the stainless steel-based heat resistant cast steel, for example, SCH22 can be used.

Before thermal spraying, the surface of the hearth roll substrate may be blasted and provided with surface roughness. Providing surface roughness allows closer contact of the thermal spray coating. The thermal spray method used may be, for example, high velocity gas spraying or plasma spraying. As examples of conditions for high velocity gas spraying, a fuel is any of kerosene, $C_3H_8$, $C_2H_2$, and $C_3H_6$, the pressure of a fuel gas ranges from 0.1 to 1 MPa, the flow rate of the fuel gas ranges from 10 to 500 l/min, in the case of kerosene, the flow rate of kerosene ranges from 15 to 30 l/hour, the pressure of an oxygen gas ranges from 0.1 to 1 MPa, and the flow rate of the oxygen gas ranges from 500 to 1200 l/min.

Additionally, the substrate of the hearth roll is preferably heated during thermal spraying. Means for heating is not particularly limited, and for example, a gas burner can be used.

EXAMPLES

With examples illustrated, the present embodiment will be specifically described below. A thermal spray coating was formed on a surface of a TP (Test Piece), and the test below was conducted. SUS304 was used as the TP. The high velocity gas spraying was used as the thermal spray coating method.

(Fe Buildup Resistance Test)

As illustrated in FIG. 1, FeO powder used as a buildup material was sandwiched between two thermal spray coatings used as TPs, and the FeO powder was also sandwiched between the upper TP and a half-moon roll. With a 10-kg load applied in an X1 direction, the half-moon roll was slid in an X2 direction at a speed of 20 reciprocations/min for four hours with respect to the TP. The test was conducted in an electric furnace under a reducing atmosphere of $N_2$-5% $H_2$ and a heating condition at 950° C.

(Mn Buildup Resistance Test)

The buildup material was changed to MnO powder, and the test was conducted similarly to the Fe buildup resistance test.

After the test, the degree of adhesion of adhering objects to the TP surface was evaluated. A sample with no adhering objects on the TP surface or a sample from which adhering objects fell when the TP was tilted was evaluated as very good (AZAA), a sample from which adhering objects fell when the TP was vibrated or wiped with gauze was evaluated as good (AA), a sample from which adhering objects fell when a tool such as tweezers was used to apply an external force to the TP was evaluated as fair (A), and a sample from which the adhering objects did not fall when the external force was applied to the TP was evaluated as poor (B).

(Thermal Shock Resistance)

The TP provided with a thermal spray coating was placed in an electric furnace, and a heating and cooling cycle was executed a plurality of times. Then, the thermal spray coating was evaluated by checking whether the thermal spray coating had been peeled off. Heating conditions included an atmospheric temperature of 1000° C. and a heating time of 30 minutes. As means for cooling, water cooling was used. A sample for which peel-off of the thermal spray coating was not observed after 40 heating cycles was evaluated as very good (AAA), a sample for which peel-off of the thermal spray coating was observed after 30 or more and less than 40 heating cycles was evaluated as good (AA), a sample for which peel-off of the thermal spray coating was observed after 20 or more and less than 30 heating cycles was evaluated as fair (A), a sample for which peel-off of the thermal spray coating was observed after 10 or more and less than 20 heating cycles was evaluated as poor (B), and a sample for which peel-off of the thermal spray coating was observed after less than 10 heating cycles was evaluated as poor (C).

(Crack Resistance)

Figure 2:
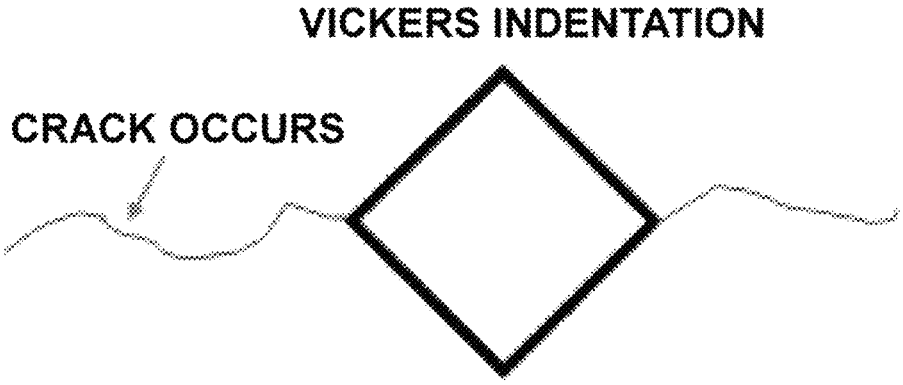
FIG. 2 is an explanatory diagram of a crack resistance test.

A tester measuring Vickers hardness was used to form 10 indentations on the thermal spray coating formed on the TP surface. A load of 1 kgf was used to form the indentations. As illustrated in FIG. 2, in a material with low crack resistance, a crack originates from the top of the indentation. In all of the ten points, a sample in which no crack was observed was evaluated as very good (AAA), a sample in which a crack was observed at one of the 10 points was evaluated as good (AA), a sample in which a crack was observed at two of the 10 points was evaluated as good (A), a sample in which a crack was observed at three or four points was evaluated as poor (B), and a sample in which a crack was observed at five or more points was evaluated as poor (C).

In Example 4, the Co-based alloy, the carbide, and the double oxide satisfied a "preferable" condition, and A/B and C/D satisfied a "more preferable" condition. In comparison with Example 4, evaluation of other samples will be described.

TABLE 1

| Sample No | Co-based alloy (mass %) | Carbide (mass %) | Double oxide (mass %) | |
|---|---|---|---|---|
| 1 | Co—32Ni—21Cr—8Al—0.6Y: 26% | Chromium carbide: 29% | $YAlO_3$: 45% | Example |
| 2 | Co—32Ni—21Cr—8Al—0.6Y: 37% | Chromium carbide: 27% | $Y_3Al_5O_{12}$: 36% | |
| 3 | Co—25Cr—8Al—0.6Y: 45% | Chromium carbide: 30% | $Y_3Al_5O_{12}$: 25% | |
| 4 | Co—5Ni—22Cr—10Al—1Y: 36.4% | Chromium carbide: 27.2% | $YAlO_3$: 36.4% | |
| 5 | Co—23Cr—13Al—1Y: 36.1% | Chromium carbide: 27.8% | $YAlO_3$: 36.1% | |
| 6 | Co—23Cr—13Al—1Y: 38.4% | Chromium carbide: 27.6% | $YAlO_3$ + $YCrO_3$: 34% | |
| 7 | Co—23Cr—13Al—1Y: 47.5% | Chromium carbide: 27.0% | $YAlO_3$ + $YCrO_3$: 25.5% | |
| 8 | Co—23Cr—13Al—1Y: 39.7% | Chromium carbide: 27.9% | $LaAlO_3$ + $LaCrO_3$: 32.4% | |
| 9 | Co—23Cr—13Al—1Y: 42.5% | Chromium carbide: 29.2% | $LaAlO_3$ + $LaCrO_3$: 28.3% | |
| 10 | Co—20Cr—10Al—0.2Y: 39.3% | Chromium carbide: 25.9% | $YAlO_3$: 34.8% | |
| 11 | Co—27Cr—6Mo—2Ni: 47.5% | Molybdenum carbide: 27.0% | $YCrO_3$: 25.5% | |
| 12 | Co—14Cr—27Mo—2.4Ni: 45.0% | Molybdenum carbide: 27.0% | $YCrO_3$: 28% | |
| 13 | Co—23Cr—13Al—1Y: 47.6% | Chromium carbide: 26.7% | $YAlO_3$ + $YCrO_3$: 25.7% | |
| 14 | Co—23Cr—13Al—1Y: 34.0% | Chromium carbide: 29.0% | $YAlO_3$: 37.0% | |
| 15 | Co—23Cr—13Al—1Y: 33.0% | Chromium carbide: 26.0% | $YAlO_3$: 41.0% | |
| 16 | Co—15Cr—13Al—2Y: 49.0% | Chromium carbide: 28.9% | $YAlO_3$: 22.1% | |
| 17 | Co—15Cr—6Al—1.9Y: 26% | Chromium carbide: 29% | $YAlO_3$: 45% | |
| 18 | Co—10Cr—13Al—1Y: 41% | Chromium carbide: 29% | $LaCrO_3$: 30% | |
| 19 | Co—10Cr—13Al—1Y: 39% | Chromium carbide: 30% | $LaALO_3$: 31% | |
| 20 | Co—10Cr—13Al—1Y: 47.0% | Chromium carbide: 27.0% | $NdAlO_3$: 26.0% | |
| 21 | Co—18Cr—8Al—1Y: 48% | Chromium carbide: 26.0% | $NdCrO_3$: 26% | |
| 22 | Co—25Cr—8Al—1Y: 39% | Chromium carbide: 27.0% | $NdAlO_3$ + $NdCrO_3$: 34% | |
| 23 | Co—23Cr—13Al—1Y: 47% | Chromium carbide: 35.0% | $YAlO_3$ + $YCrO_3$: 18% | Comparative |
| 24 | Co—23Cr—13Al—1Y: 50% | Chromium carbide: 4% | $YCrO_3$: 46% | Example |
| 25 | Co—23Cr—13Al—1Y: 22% | Chromium carbide: 40% | $YAlO_3$: 38% | |
| 26 | Co—23Cr—13Al—1Y: 18% | Chromium carbide: 55% | $YAlO_3$ + $YCrO_3$: 27% | |
| 27 | Co—23Cr—13Al—1Y: 53% | Chromium carbide: 29% | $LaCrO_3$: 18% | |
| 28 | Co—32Ni—21Cr—8Al—0.6Y: 55% | Chromium carbide: 30% | $Y_3Al_5O_{12}$: 15% | |
| 29 | Co—23Cr—13Al—1Y: 55% | Chromium carbide: 28% | $LaAlO_3$: 17% | |
| 30 | Co—23Cr—13Al—1Y: 54.0% | Chromium carbide: 28% | $NdAlO_3$: 18.0% | |
| 31 | Co—23Cr—13Al—1Y: 33% | Chromium carbide: 20.0% | $NdCrO_3$: 47% | |
| 32 | Co—14Cr—27Mo—2.4Ni: 37.0% | Molybdenum carbide: 35.0% | $YCrO_3$: 28% | |

| Sample No | A/B | C/D | Fe buildup resistance | Mn buildup resistance | Thermal shock resistance | Crack resistance | |
|---|---|---|---|---|---|---|---|
| 1 | 3.8 | 2.2 | AA | AA | A | A | Example |
| 2 | 3.8 | 3.1 | AA | AA | AAA | AAA | |
| 3 | 1.5 | 3.2 | A | A | A | A | |
| 4 | 3.0 | 2.4 | AAA | AAA | AAA | AAA | |
| 5 | 4.0 | 2.5 | AA | AA | AAA | AAA | |
| 6 | 3.5 | 2.7 | AA | AA | AAA | AAA | |
| 7 | 2.0 | 3.7 | A | A | AAA | AAA | |
| 8 | 4.0 | 2.8 | AA | AA | AAA | AAA | |
| 9 | 3.8 | 3.8 | A | A | A | A | |
| 10 | 3.2 | 2.8 | AA | AA | AAA | AAA | |
| 11 | 2.0 | 3.2 | A | A | AAA | AAA | |
| 12 | 1.0 | 2.8 | A | A | AA | AA | |
| 13 | 1.5 | 3.0 | A | A | AAA | AAA | |
| 14 | 3.8 | 2.5 | AA | AA | A | A | |
| 15 | 2.9 | 2.1 | AAA | AAA | A | A | |
| 16 | 2.3 | 3.5 | A | A | A | A | |
| 17 | 3.8 | 1.4 | AA | AA | A | A | |
| 18 | 1.5 | 3.2 | A | A | A | A | |
| 19 | 1.5 | 2.8 | AAA | AAA | A | A | |
| 20 | 1.5 | 3.5 | A | A | AAA | AAA | |
| 21 | 1.5 | 3.8 | A | A | AAA | AAA | |
| 22 | 1.5 | 3.3 | AA | AA | AAA | AAA | |
| 23 | 1.5 | 4.8 | B | B | B | B | Comparative |
| 24 | 5.0 | 2.6 | B | B | B | B | Example |
| 25 | 0.5 | 1.9 | AAA | A | C | C | |
| 26 | 0.3 | 2.0 | AAA | A | C | C | |
| 27 | 1.5 | 7.1 | B | B | A | A | |
| 28 | 1.5 | 4.6 | B | B | A | A | |
| 29 | 1.5 | 7.1 | B | C | AAA | AAA | |
| 30 | 1.5 | 6.8 | B | C | AAA | AAA | |
| 31 | 0.4 | 2.6 | AAA | AAA | C | C | |
| 32 | 2.0 | 2.5 | AAA | AAA | B | B | |

Example 1

In comparison with Example 4, the amount of Co-based alloy decreased, the amount of carbide increased, and the amount of double oxide increased, thus reducing the thermal shock resistance and the crack resistance. However, the range of the present invention was satisfied, and thus the evaluations of the thermal shock resistance and the crack resistance satisfied "A." Additionally, A/B increased from the "more preferable range" to the "preferable range," the evaluations of the Fe buildup resistance and the Mn buildup resistance lowered to "AA."

Example 2

The Co-based alloy, the carbide, and the double oxide satisfied the "preferable range", however, in comparison with Example 4, A/B increased to change from the "more preferable range" to the "preferable range," and thus the evaluations of the Fe buildup resistance and the Mn buildup resistance lowered to "AA."

Example 3

In comparison with Example 4, the Co-based alloy increased, and thus the evaluations of the Fe buildup resistance and the Mn buildup resistance lowered. However, the range of the present invention was satisfied, and thus the evaluations of the Fe buildup resistance and the Mn buildup resistance satisfied "A." In comparison with Example 4, the carbide increased, and thus the evaluations of the thermal shock resistance and the crack resistance lowered. However, the range of the present invention was satisfied, and thus the evaluations of the thermal shock resistance and the crack resistance satisfied "A."

Example 5

In comparison with Example 4, A/B increased to change from the "more preferable range" to the "preferable range," and thus the evaluations of the Fe buildup resistance and the Mn buildup resistance lowered to "AA."

Example 6

In comparison with Example 4, A/B increased to change from the "more preferable range" to the "preferable range," and thus the evaluations of the Fe buildup resistance and the Mn buildup resistance lowered to "AA."

Example 7

In comparison with Example 4, the Co-based alloy increased and C/D also increased to change from the "more preferable range" to the "preferable range," and thus the evaluations of the Fe buildup resistance and the Mn buildup resistance lowered. However, the range of the present invention was satisfied, and thus the evaluations of the Fe buildup resistance and the Mn buildup resistance satisfied "A."

Example 8

The Co-based alloy, the carbide, and the double oxide satisfied the "preferable range", however, in comparison with Example 4, A/B increased to change from the "more preferable range" to the "preferable range," and thus the evaluations of the Fe buildup resistance and the Mn buildup resistance lowered to "AA."

Example 9

In comparison with Example 4, the Co-based alloy increased and both A/B and C/D increased to change from the "more preferable range" to the "preferable range," and thus the evaluations of the Fe buildup resistance and the Mn buildup resistance lowered. However, the range of the present invention was satisfied, and thus the evaluations of the Fe buildup resistance and the Mn buildup resistance satisfied "A." In comparison with Example 4, the carbide increased, and thus the evaluations of the thermal shock resistance and the crack resistance lowered. However, the range of the present invention was satisfied, and thus the evaluations of the thermal shock resistance and the crack resistance satisfied "A."

Example 10

In comparison with Example 4, A/B increased to change from the "more preferable range" to the "preferable range," and thus the evaluations of the Fe buildup resistance and the Mn buildup resistance lowered to "AA."

Example 11

In comparison with Example 4, the Co-based alloy increased, and thus the evaluations of the Fe buildup resistance and the Mn buildup resistance lowered. However, the range of the present invention was satisfied, and thus the evaluations of the Fe buildup resistance and the Mn buildup resistance satisfied "A."

Example 12

In comparison with Example 4, the Co-based alloy increased, and thus the evaluations of the Fe buildup resistance and the Mn buildup resistance lowered. However, the range of the present invention was satisfied, and thus the evaluations of the Fe buildup resistance and the Mn buildup resistance satisfied "A."

Example 13

In comparison with Example 4, the Co-based alloy increased, and thus the evaluations of the Fe buildup resistance and the Mn buildup resistance lowered. However, the range of the present invention was satisfied, and thus the evaluations of the Fe buildup resistance and the Mn buildup resistance satisfied "A."

Example 14

In comparison with Example 4, the carbide increased, and thus the evaluations of the thermal shock resistance and the crack resistance lowered. However, the range of the present invention was satisfied, and thus the evaluations of the thermal shock resistance and the crack resistance satisfied "A." Additionally, A/B increased to change from the "more preferable range" to the "preferable range," and thus the evaluations of the Fe buildup resistance and the Mn buildup resistance lowered to "AA."

Example 15

In comparison with Example 4, the double oxide increased, and thus the evaluations of the thermal shock resistance and the crack resistance lowered. However, the range of the present invention was satisfied, and thus the evaluations of the thermal shock resistance and the crack resistance satisfied "A."

Example 16

In comparison with Example 4, the Co-based alloy increased, and the double oxide decreased, and thus the evaluations of the Fe buildup resistance and the Mn buildup resistance lowered. However, the range of the present invention was satisfied, and thus the evaluations of the Fe buildup resistance and the Mn buildup resistance satisfied "A." In comparison with Example 4, the carbide increased, and thus the evaluations of the thermal shock resistance and the crack resistance lowered. However, the range of the present invention was satisfied, and thus the evaluations of the thermal shock resistance and the crack resistance satisfied "A."

Example 17

In comparison with Example 4, the Co-based alloy decreased, and the carbide and the double oxide increased, and thus the evaluations of the thermal shock resistance and the crack resistance lowered. However, the range of the present invention was satisfied, and thus the evaluations of the thermal shock resistance and the crack resistance satisfied "A." Additionally, A/B increased to change from the "more preferable range" to the "preferable range," and thus the evaluations of the Fe buildup resistance and the Mn buildup resistance lowered to "AA."

Example 18

In comparison with Example 4, the Co-based alloy increased, and thus the evaluations of the Fe buildup resistance and the Mn buildup resistance lowered. However, the range of the present invention was satisfied, and thus the evaluations of the Fe buildup resistance and the Mn buildup resistance satisfied "A." In comparison with Example 4, the carbide increased, and thus the evaluations of the thermal shock resistance and the crack resistance lowered. However, the range of the present invention was satisfied, and thus the evaluations of the thermal shock resistance and the crack resistance satisfied "A."

Example 19

In comparison with Example 4, the carbide increased, and thus the evaluations of the thermal shock resistance and the crack resistance lowered. However, the range of the present invention was satisfied, and thus the evaluations of the thermal shock resistance and the crack resistance satisfied "A."

Example 20

In comparison with Example 4, the Co-based alloy increased, and C/D increased to change from the "more preferable range" to the "preferable range," and thus the evaluations of the Fe buildup resistance and the Mn buildup resistance lowered. However, the range of the present invention was satisfied, and thus the evaluations of the Fe buildup resistance and the Mn buildup resistance satisfied "A."

Example 21

In comparison with Example 4, the Co-based alloy increased, and C/D increased to change from the "more preferable range" to the "preferable range," and thus the evaluations of the Fe buildup resistance and the Mn buildup resistance lowered. However, the range of the present invention was satisfied, and thus the evaluations of the Fe buildup resistance and the Mn buildup resistance satisfied "A."

Example 22

In comparison with Example 4, C/D increased to change from the "more preferable range" to the "preferable range," and thus the evaluations of the Fe buildup resistance and the Mn buildup resistance lowered to "AA."

Examples 23, 24, and 27

In comparison with Example 4, A/B increased to change from the "more preferable range" to the "preferable range," and thus the evaluations of the Fe buildup resistance and the Mn buildup resistance lowered to "AA."

Example 25

In comparison with Example 4, the Co-based alloy increased, and thus the evaluations of the Fe buildup resistance and the Mn buildup resistance lowered. However, the range of the present invention was satisfied, and thus the evaluations of the Fe buildup resistance and the Mn buildup resistance satisfied "A."

Comparative Example 1

In comparison with Example 4, the Co-based alloy increased and the double oxide excessively decreased. Additionally, C/D increased and departed from the preferable range of the present invention. Thus, the evaluations of the Fe buildup resistance and the Mn buildup resistance lowered to "B." Additionally, in comparison with Example 4, the carbide excessively increased, and thus the evaluations of the thermal shock resistance and the crack resistance lowered to "B."

Comparative Example 2

In comparison with Example 4, the Co-based alloy increased and the carbide excessively decreased, and thus the evaluations of the Fe buildup resistance and the Mn buildup resistance lowered to "B." The double oxide excessively increased, and thus the evaluations of the thermal shock resistance and the crack resistance lowered to "B."

Comparative Examples 3 and 4

In comparison with Example 4, the Co-based alloy excessively decreased and the carbide excessively increased, and thus evaluations of the thermal shock resistance and the crack resistance significantly lowered.

Comparative Examples 5 and 6

In comparison with Example 4, the Co-based alloy and C/D excessively increased and the double oxide excessively decreased, and thus the evaluations of the Fe buildup resistance and the Mn buildup resistance significantly lowered. In comparison with Example 4, the carbide increased, and thus the evaluations of the thermal shock resistance and the crack resistance lowered. However, the carbide satisfied the range of the present invention, and thus the evaluations of the thermal shock resistance and the crack resistance satisfied A.

Comparative Examples 7 and 8

In comparison with Example 4, the Co-based alloy and C/D excessively increased and the double oxide excessively decreased, and thus the evaluations of the Fe buildup resistance and the Mn buildup resistance significantly lowered.

Comparative Example 9

In comparison with Example 4, the double oxide excessively increased, and A/B excessively decreased, and thus the evaluations of the thermal shock resistance and the crack resistance significantly lowered.

Comparative Example 10

In comparison with Example 4, the carbide excessively increased, and thus the evaluations of the thermal shock resistance and the crack resistance significantly lowered.

The invention claimed is:

1. A hearth roll for a continuous annealing furnace, the hearth roll comprising a thermal spray coating on a surface of the hearth roll, wherein the thermal spray coating comprises main components consisting of a Co-based alloy, a carbide of a transition metal, and a double oxide, and impurities, the double oxide consists of one type consisting of a second double oxide consisting of a transition metal and a rare earth element, a content of the Co-based alloy is 25 mass % or more and 50 mass % or less of the main components, a content of the carbide is 5 mass % or more and 30 mass % or less of the main components, and a content of the double oxide is 20 mass % or more and 45 mass % or less of the main components, $2/3 \leq (A/B) \leq 4$ is satisfied, where A and B respectively denote a molar quantity of the transition metals and a molar quantity of carbon in the carbide, and $1 \leq (C/D) \leq 4$ is satisfied, where C denotes a molar quantity of the transition metals not constituting the carbide in the main components, and D denotes a molar quantity of the rare earth element included in the main components.

2. The hearth roll for the continuous annealing furnace according to claim 1, wherein the Co-based alloy is selected from the group consisting of a CoCrAlY-based heat resistant alloy, a CoNiCrAlY-based heat resistant alloy, and a CoCrMoNi-based heat resistant alloy.

3. The hearth roll for the continuous annealing furnace according to claim 1, wherein the carbide is selected from the group consisting of a chromium carbide and a molybdenum carbide.

4. The hearth roll for the continuous annealing furnace according to claim 1, wherein the second double oxide is selected from the group consisting of $LaCrO_3$, $NdCrO_3$, and $YCrO_3$.

* * * * *